US009540906B2

(12) United States Patent
Kang

(10) Patent No.: US 9,540,906 B2
(45) Date of Patent: Jan. 10, 2017

(54) REMOTE-OPEN INFLOW CONTROL DEVICE WITH SWELLABLE ACTUATOR

(71) Applicant: HALLIBURTON ENERGY SERVICES, INC., Houston, TX (US)

(72) Inventor: James Kang, Dallas, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 14/115,925

(22) PCT Filed: Jan. 14, 2013

(86) PCT No.: PCT/US2013/021481

§ 371 (c)(1),
(2) Date: Nov. 6, 2013

(87) PCT Pub. No.: WO2014/109773

PCT Pub. Date: Jul. 17, 2014

(65) Prior Publication Data

US 2015/0300123 A1 Oct. 22, 2015

(51) Int. Cl.

| | |
|---|---|
| ***E21B 43/12*** | (2006.01) |
| ***E21B 43/08*** | (2006.01) |
| ***E21B 34/10*** | (2006.01) |
| ***E21B 43/14*** | (2006.01) |

(52) U.S. Cl.
CPC ..... *E21B 34/10* (2013.01); *E21B 43/08* (2013.01); *E21B 43/12* (2013.01); *E21B 43/14* (2013.01)

(58) Field of Classification Search
CPC .... E21B 34/00; E21B 2034/007; E21B 34/10; E21B 43/14; E21B 43/08; E21B 43/12; E21B 34/01; E21B 34/08
See application file for complete search history.

(56) References Cited

U.S. PATENT DOCUMENTS

| | | | | |
|---|---|---|---|---|
| 3,856,081 | A * | 12/1974 | Canalizo | E21B 23/02 166/123 |
| 7,469,743 | B2 | 12/2008 | Richards | |
| 7,762,341 | B2 * | 7/2010 | Hammer | E21B 34/08 166/187 |
| 7,802,621 | B2 | 9/2010 | Richards et al. | |
| 7,828,067 | B2 * | 11/2010 | Scott | E21B 43/12 166/386 |
| 2007/0246213 | A1 * | 10/2007 | Hailey, Jr. | E21B 43/04 166/278 |
| 2007/0246225 | A1 * | 10/2007 | Hailey, Jr. | E21B 21/103 166/386 |
| 2008/0149323 | A1 * | 6/2008 | O'Malley | E21B 34/06 166/53 |
| 2008/0283238 | A1 * | 11/2008 | Richards | E21B 23/04 166/228 |
| 2011/0067886 | A1 | 3/2011 | Moen | |

* cited by examiner

*Primary Examiner* — Michael Wills, III

(57) ABSTRACT

A flow control assembly for regulating fluid flow in a wellbore is disclosed. A remote-open ICD is opened in response to swelling of a swellable actuator. The swellable actuator can move a flow regulator radially, circumferentially, etc., such that flow is allowed through the regulator. Alternately, the swellable actuator can move one or more valve members to an open position thereby allowing fluid to flow across the valve and to the flow regulator. The swellable actuator can be swelled in response to introduction of chemicals or heat. A guide mechanism can be used to control swelling of the actuator or movement of the regulator device or valve member.

27 Claims, 8 Drawing Sheets

REMOTE-OPEN INFLOW CONTROL DEVICE WITH SWELLABLE ACTUATOR

FIELD

This application relates generally to methods and apparatus for controlling fluid flow in a wellbore, and more particularly to an improved inflow control device (ICD).

BACKGROUND

Without limiting the scope of the present inventions, their background is described with reference to Inflow Control Devices (ICDs) and design improvements thereto. Inflow Control Devices are designed to improve completion performance and efficiency by balancing inflow throughout the length of a completion. Differences in influx from the reservoir can result in premature water/gas breakthrough, leaving valuable resources in the ground. Typical applications include wells experiencing "heel-toe" effects, breakthrough of water/gas, permeability differences, and water challenges in high viscous oil reservoirs. Another benefit of this technology is that it can balance the fluid injected into the formation in injection wells. U.S. Pat. Nos. 7,469,743 and 7,802,621, the entire disclosures of which are incorporated herein by reference for all purposes, disclose ICDs for sand control screens.

An example of an inflow control device is commercially available from Halliburton Energy Services, Inc. under the trade mark EquiFlow® Inflow Control Device. The EquiFlow® ICD consists of an annular chamber on a standard oilfield tubular. If screen is required, the reservoir fluid is produced from the formation, through the sand screen and into the flow chamber. The flow continues through a set of tubes, which creates a pressure drop, and then into the pipe through a set of ports. Tube length and ID are designed to give the pressure drop needed for optimum completion efficiency. EquiFlow® Adjustable ICDs are pre-configured with a set of tubes that may be re-configured on the rig to change the pressure drop. A slidable housing provides flow tube access. Typically, multiple tubes per ICD are used. Disclosure regarding the EquiFlow® ICD is available online.

In many applications, it is beneficial to run the ICD in a closed position during installation. This allows for circulation of fluid down to the shoe and up the annular space outside of a sand screen without using a wash pipe. It is also possible to pressurize the completion to activate other components, like open hole packers. A delayed opening valve has been developed as well. This valve is activated by applying a high tubing pressure to shear a mechanism. Halliburton Energy Services, Inc. manufactures and markets a remotely-opened valve for use with ICDs which holds internal pressure when closed, but opens the screen to full production flow after sufficient internal pressure is applied and released. A remote-open valve is typically installed on each joint of screen, with the valves in the closed position as the screens are run into the well. The valves are sealed to internal pressure only, allowing the screens to fill with well fluid when they are run into the well. When the valves are closed, the entire completion assembly including the screens can be pressurized internally to pressure test the tubing, and pressure can be applied to set downhole devices, such as packer or other operational tools in the completion string. The valve mechanism is made up of a collet and ball assembly with the collet held in a run-in position by an externally inserted shear pin. When enough pressure is applied, the shear pin shears, the collet shifts and locks in an open position while still holding tubing pressure. The number of remote-open valve units is determined by the flow rate required or desired.

U.S. Pat. No. 7,762,341, the entire disclosure of which is incorporated herein by reference for all purposes, discloses a flow control device utilizing a reactive media, comprising a flow path associated with a production control device (e.g., sand screen and ICD); an "occlusion member" (e.g., piston) positioned along the flow path that moves between an open position and a closed position, the occlusion member being activated by a change in a pressure differential in the flow path; and a "reactive media" (e.g., a water swellable material or an oil swellable material) disposed along the flow path that changes a pressure differential across at least a portion of the flow path by interacting with a selected fluid (e.g., water, of a sufficient concentration or amount, encountered by the production control device) to thereby actuate the occlusion member.

U.S. Pat. App. Pub. No. 2011/0067886, the entire disclosure of which is incorporated herein by reference for all purposes, discloses a completion assembly with a valve assembly for regulating fluid flow in a wellbore. The completion assembly can include a base pipe with a sand screen. A flow control housing is disposed on one end of the sand screen. A first tubular port in the base pipe leads into the flow control housing, and a second tubular port is also formed in the base pipe. A flow path is formed within the flow control housing and communicates with both the base pipe and the inner annulus of the screen assembly. A valve assembly is located in the flow control housing and is in fluid communication with both the inner annulus and the base pipe. The valve assembly is positionable between multiple positions for controlling the flow through the flow control flow path in response to fluid pressure applied to the second tubular port.

Therefore, it will be appreciated that advancements in the art of inflow control devices are desirable, and such advancements are also beneficial in a wide variety of circumstances.

SUMMARY

In aspects, the present disclosure provides a remote-open ICD using a swellable actuator of swellable material, such as selected rubbers or polymers. In one aspect, fluid flow is regulated between a wellbore and a tubular by moving a flow regulator device, such as an elongated tube, restrictor, etc., from a closed position to an open position wherein fluid flows through the flow regulator device in response to swelling of a swellable actuator. The swellable actuator is positioned adjacent the flow regulator and moves the regulator between positions upon swelling.

The downhole tubular can also include a sand screen assembly, etc., as desired. Swelling the actuator can move the regulator device radially outward, radially inward, circumferentially or otherwise. The swellable actuator can be swelled in response to a chemical or heat. A guide mechanism can be used to control swelling of the actuator or control movement of the regulator device. Alternately, swelling of the actuator can move a valve member from a closed to an open device rather than moving the regulator device directly. In the open position, fluid is allowed to flow through the open valve member and through the flow regulator. Swellable materials are predictable, low cost, and in this case, easily implemented.

DRAWINGS

For a more complete understanding of the features and advantages of the present invention, reference is now made to the detailed description of the invention along with the accompanying figures in which corresponding numerals in the different figures refer to corresponding parts and in which.

Figure 1:
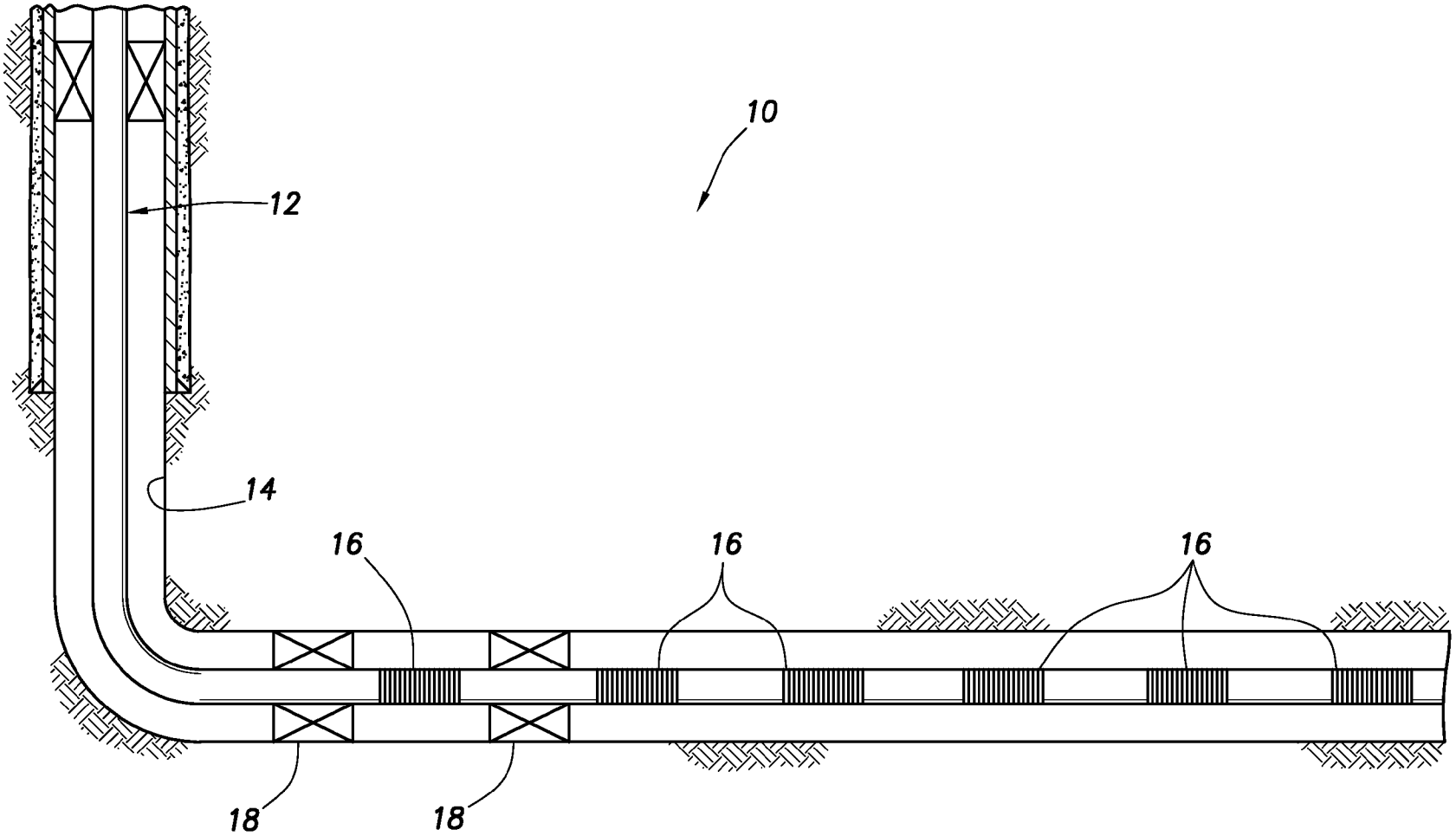
FIG. 1 is a schematic partially cross-sectional view of an exemplary generic well system including multiple well screens.
Figure 3A:
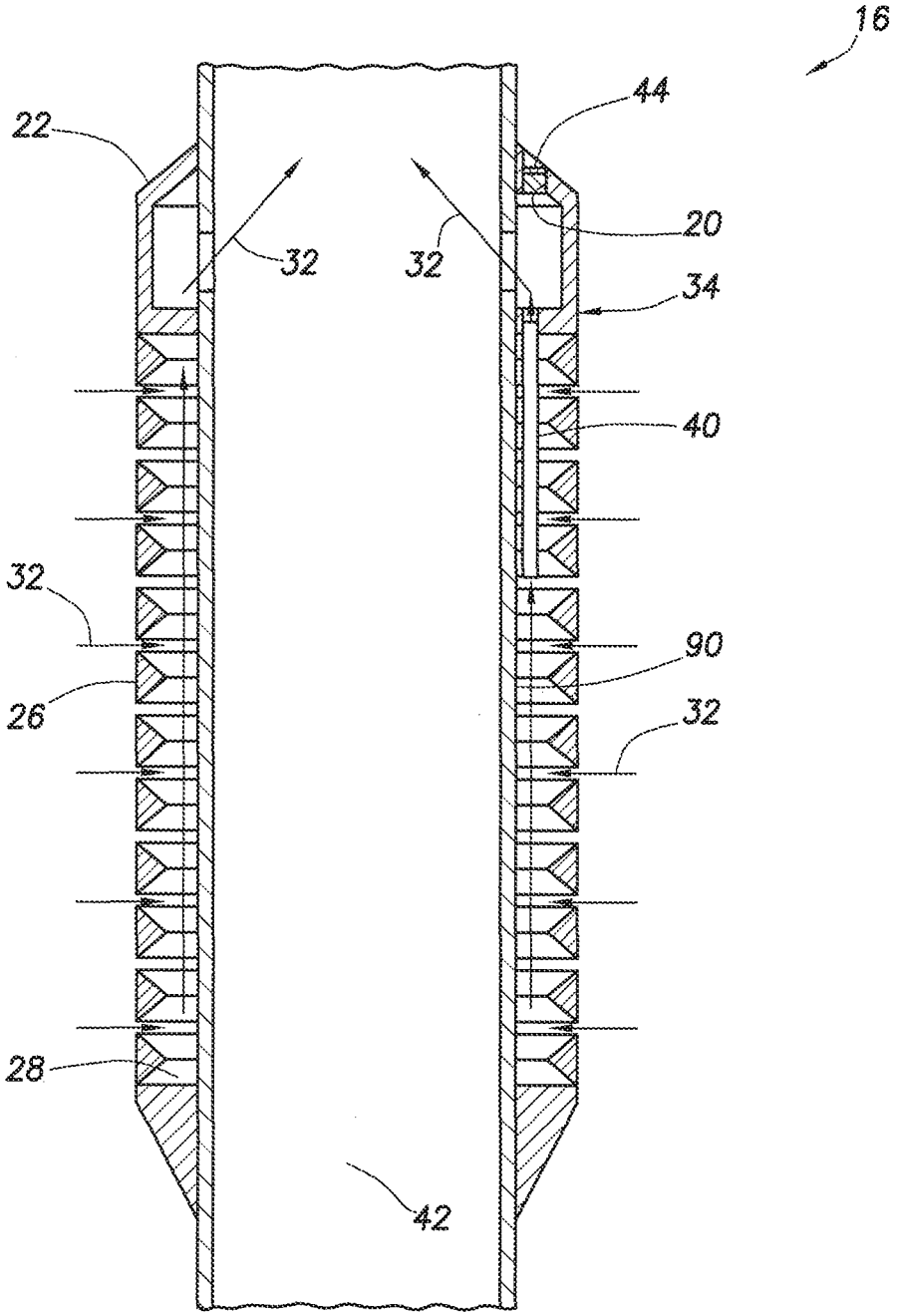
FIG.3A (PRIOR ART)
Figure 3B:
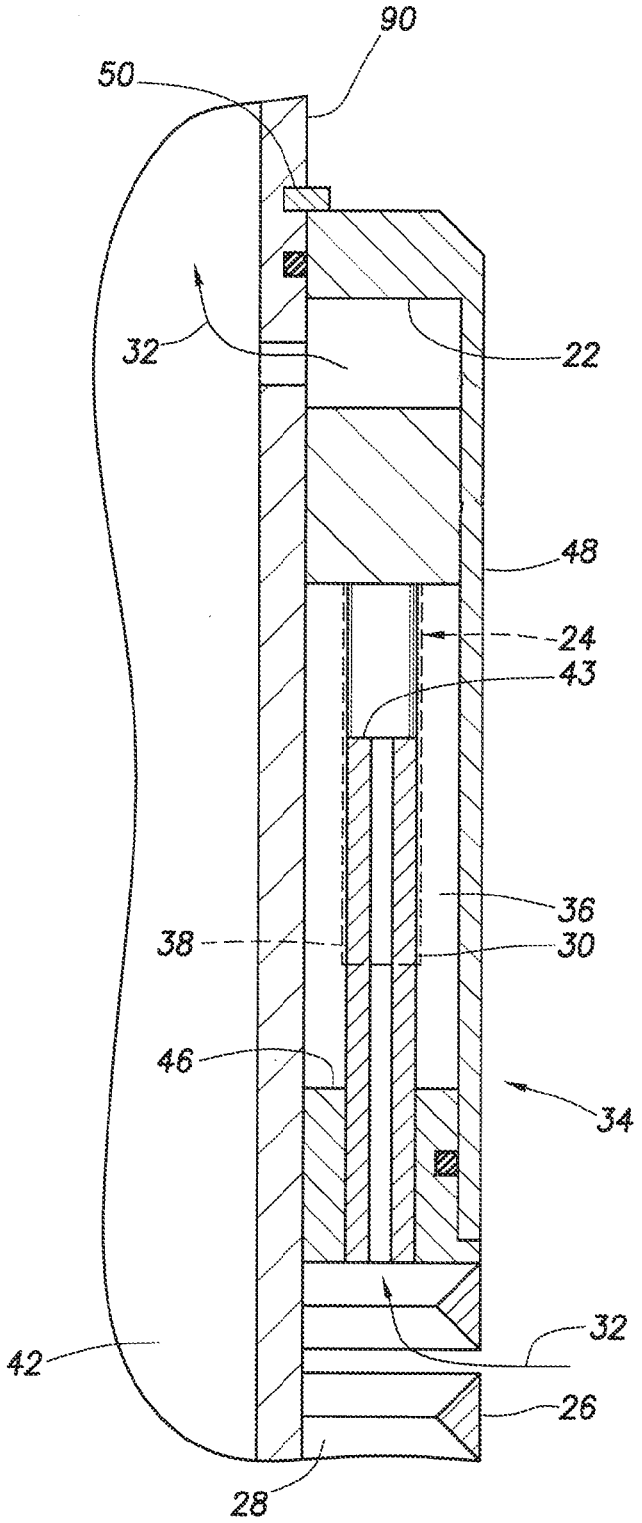
FIG.3B (PRIOR ART)
Figure 4A:
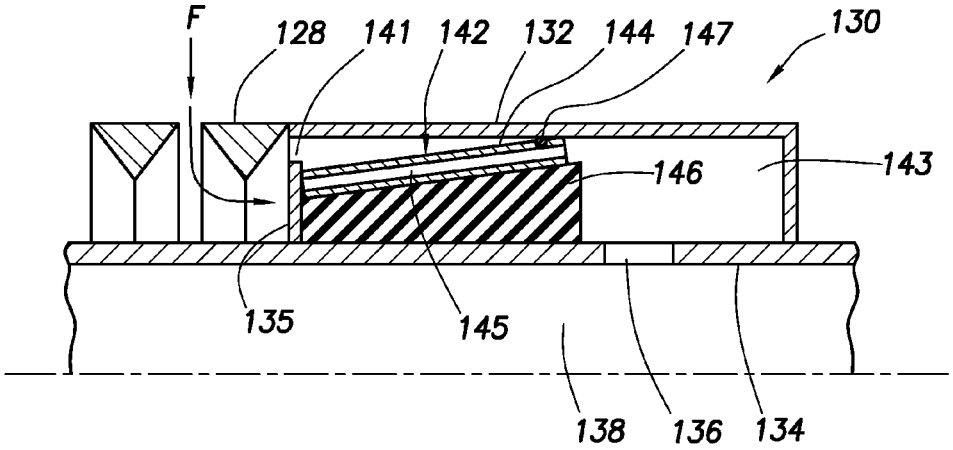
Figure 4B:
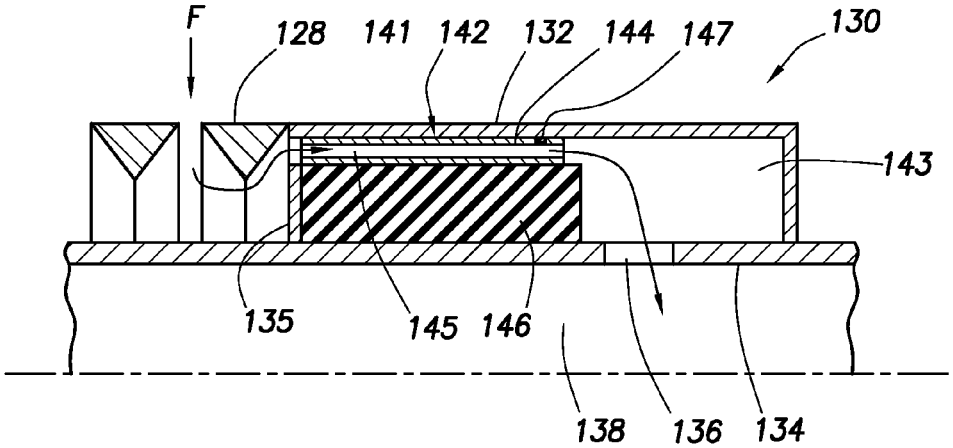
Figure 4C:
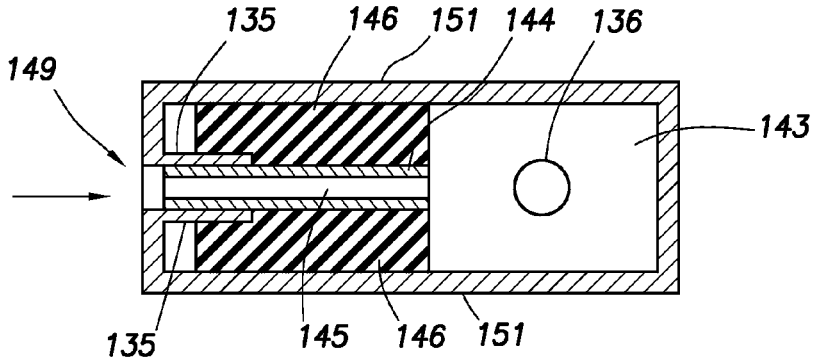

FIGS. 3A-B are enlarged scale cross-sectional views of an exemplary well screen which may be used in the system of FIG. 1;

FIGS. 4A-C are cross-sectional views of an inflow control device in accordance with the present disclosure; and FIGS. 5A-D are schematic cross-sectional views of an alternate embodiment of an inflow control device in accordance with the present disclosure.

DETAILED DESCRIPTION OF PREFERRED EMBODIMENTS

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

FIG. 1 shows an exemplary generic well system 10. A production tubing string 12 is installed in a wellbore 14 of a well. The tubing string 12 includes multiple well screens 16 positioned in an uncased generally horizontal portion of the wellbore 14.

One or more of the well screens 16 may be positioned in an isolated portion of the wellbore 14, for example, between packers 18 set in the wellbore. In addition, or alternatively, many of the well screens 16 could be positioned in a long, continuous portion of the wellbore 14, without packers isolating the wellbore between the screens.

Gravel packs could be provided about any or all of the well screens 16, if desired. A variety of additional well equipment (such as valves, sensors, pumps, control and actuation devices, etc.) could also be provided in the well system 10.

The screens 16 could instead be positioned in a cased and perforated portion of a wellbore, the screens could be positioned in a generally vertical portion of a wellbore, the screens could be used in an injection well, rather than in a production well, etc.

Figure 2:
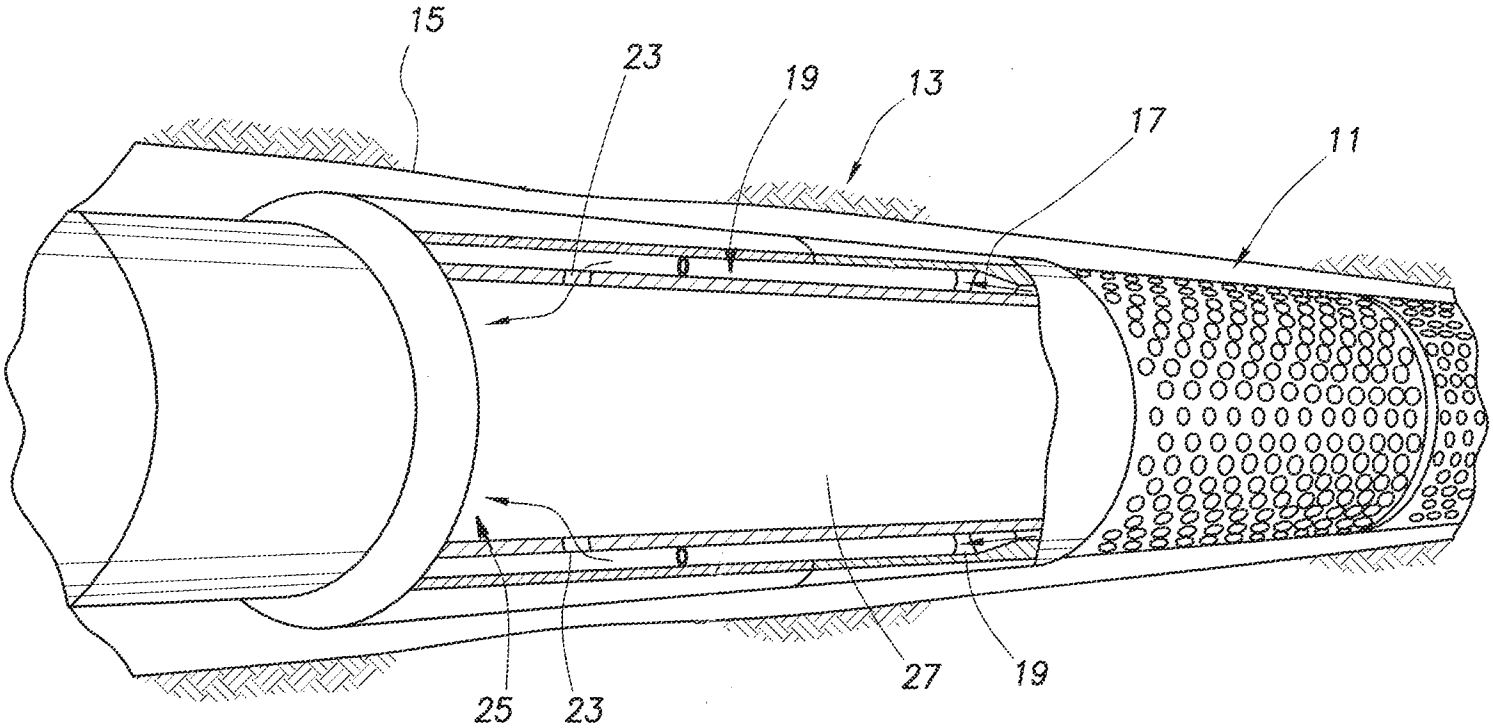
FIG.2 (PRIOR ART)
FIG. 2 is a schematic view of an exemplary sand screen and ICD positioned in a wellbore which may be used in a system such as that of FIG. 1.

FIGS. 2-4 are presented and discussed in illustration of prior art devices and methods regarding Inflow Control Devices and their use. The presented embodiments are exemplary in nature and not intended to be limiting or representative of all current or possible designs utilizing ICDs. It will be apparent to those of skill in the art that these and other designs can be used or readily modified to incorporate the inventions described herein.

FIG. 2 is a schematic view of an exemplary downhole screen assembly and Inflow Control Device. A screen assembly 11 is attached to and in fluid communication with an ICD 13 and positioned in a subterranean wellbore 15. Fluid flows radially from the reservoir into the sand screen and then longitudinally from the screen through a plurality of ICD ports 17 and into ICD passageways 19. After flowing through the ICD 13, the fluid flows through one or more base pipe ports 23 and into the interior passageway 25 of the base pipe. The ICD 13, positioned in an ICD passageway 19, operates to control fluid inflow into the production (or other) string. The ICD 13 in a preferred embodiment is an elongated tube or tubes having selected dimensions to control flow rates therethrough dependent upon wellbore and fluid characteristics and acts as a flow restrictor. The elongated tubes or flow restrictors can employ sized orifices, flow nozzles, autonomous inflow control devices, tortuous paths, etc. Incorporated herein by reference for all purposes is the data sheet entitled EquiFlow® Inflow Control Devices (2009 Halliburton Energy Services, Inc.) (H05600), available on-line and product available commercially.

Additional disclosure regarding ICDs, including their use in conjunction with sliding side doors, remote open valves, etc., can be found, for example, in the data sheets entitled *PetroGuard® Screen and EquiFlow® ICD with Remote Open Valve* (2011 Halliburton Energy Services, Inc.) (H08697), and *EquiFlow® Sliding Side-Door® Inflow Control Device* (2011 Halliburton Energy Services, Inc.) (H08626), which are incorporated herein in their entirety for all purposes and which products are commercially available.

FIG. 3 is an enlarged scale schematic cross-sectional view of an exemplary sand screen utilizing an ICD 34. A fluid 32 flows inwardly through a filter portion 26 of the screen 16. The filter portion 26 is depicted as being made up of wire wraps, but other types of filter material (such as mesh, sintered material, pre-packed granular material, etc.) may be used. The fluid 32 enters an annular space 28 between the filter portion 26 and a tubular base pipe 90 of the screen 14. The fluid 32 then passes through an inflow control device 34, and into a flow passage 42 extending longitudinally through the screen 16. When interconnected in a tubing string, such as string 12 seen in the well system 10 of FIG. 1, the flow passage 42 is a part of a flow passage extending through the tubing string.

Although the flow passage 42 is depicted as extending internally through the filter portion 26, it will be appreciated that other configurations are possible. For example, the flow passage could be external to the filter portion, in an outer shroud of the screen 16, etc.

The inflow control device 34 includes one or more flow restrictors 40 (only one of which is visible in FIG. 3A) to restrict inward flow through the screen 16 (i.e., between the filter portion 26 and the flow passage 42). As depicted in FIG. 3A, the flow restrictor 40 is in the shape of an elongated tube. The length, inner diameter and other characteristics of the tube may be varied to thereby vary the restriction to flow of the fluid 32 through the tube.

Although the inflow control device 34 is described herein as being used to restrict flow of fluid from the filter portion 26 to the flow passage 42, it will be appreciated that other configurations are possible. For example, if the flow passage is external to the filter portion 26, then the inflow control device could restrict flow of fluid from the flow passage to the filter portion, etc.

As depicted in FIG. 3A, the flow restrictor 40 is accessible via an opening 20 formed in an end wall 22 of the inflow control device 34. A plug 44 blocks flow through the opening 20. To install the flow restrictor 40 in the inflow control device 34, appropriate threads, seals, etc. may be provided to secure and seal the flow restrictor. The plug 44 is then installed in the opening 20 using appropriate threads, seals, etc.

Referring additionally now to FIG. 3B, an enlarged scale schematic cross-sectional view of the inflow control device 34 is representatively illustrated. The inflow control device 34 as depicted in FIG. 3B may be used in the well screen 16, or it may be used in other well screens. The inflow control device 34 includes multiple flow restrictors 24, 30 configured in series. The flow restrictors 24, 30 are in the shape of elongated tubes, similar to the flow restrictor 40 described above. However, in the embodiment of FIG. 3B, the flow restrictors 24, 30 are positioned so that the fluid 32 must change direction twice in order to flow between the flow restrictors. The flow restrictors 24, 30 extend into a central chamber 36. Ends 38, 43 of the flow restrictors 24, 30 extend in opposite directions, and the flow restrictors overlap laterally, so that the fluid 32 is forced to reverse direction twice in flowing between the flow restrictors.

From the annular space 28, the fluid 32 flows into the flow restrictors 30 which are installed in a bulkhead 46. Any means of sealing and securing the flow restrictors 30 in the bulkhead 46 may be used. The flow restrictors 30 restrict the flow of the fluid 32, so that a pressure drop results between the annular space 28 and the chamber 36.

The pressure drop between the annular space 28 and the chamber 36 may be adjusted by varying the number of the flow restrictors 30, varying the inner diameter, length and other characteristics of the flow restrictors.

The flow restrictors 24, 30 may be conveniently accessed and installed or removed by removing an outer housing 48 of the device 34. A snap ring or other securement 50 may be used to provide convenient removal and installation of the outer housing 48, thereby allowing the flow restrictors 24, 30 to be accessed at a jobsite. Alternatively, openings and plugs could be provided in the end wall 22 for access to the flow restrictors 24, 30.

After the fluid 32 flows out of the ends 43 of the flow restrictors 30, the fluid enters the chamber 36. Since the ends 38, 43 of the flow restrictors 24, 30 overlap, the fluid 32 is forced to reverse direction twice before entering the ends 38 of the flow restrictors 24. These abrupt changes in direction cause turbulence in the flow of the fluid 32 and result in a further pressure drop between the flow restrictors 24, 30. As the fluid 32 flows through the flow restrictors 24, a further pressure drop results. As discussed above, the restriction to flow through the flow restrictors 24 may be altered by varying the length, inner diameter, and other characteristics of the flow restrictors.

FIGS. 4A-C show an exemplary in-flow control device 130 in accordance with one embodiment of the present disclosure. FIGS. 4A-B are cross-sectional elevational schematic views of an ICD assembly positioned on a base pipe in a closed and an open positions. FIG. 4C is a detail, cross-sectional top view of an exemplary flow control housing and ICD assembly.

Screen 128 is disposed on bass pipe 134 and is open to fluid flow from the reservoir. Fluid then flows longitudinally along the screen to flow control housing 132. Flow control housing 132 is disposed on base pipe 134 defining a chamber 143. Base pipe 134, which defines an interior passageway 138, has a port or ports 136 allowing fluid communication between chamber 143 of the flow control housing and the interior passageway 138 of the base pipe 134. The flow control housing further includes a screen port 141 for allowing fluid flow between the screen assembly and the chamber of the fluid flow control housing. A flow control flow path, indicated by arrows, is defined through flow control housing 132 and communicable with both the interior passageway of the base pipe 134 and the screen assembly (and hence, the annular space exterior to the tubing string.

ICD assembly 142 is disposed in the flow control housing 132 and along the flow control flow path. The ICD assembly includes a flow restrictor 144, a swellable actuator 146, sealing devices 147, and a movement guide assembly 149. The flow restrictor 144 in seen in the shape of an elongated tube having selected dimensions and characteristics to control fluid flow therethrough in accordance with the desires of the user. As discussed above, the restrictor can take other forms and have additional characteristics, as desired. Restrictor 144 defines a fluid passageway 145 therethrough and is movable between a closed position, seen in FIG. 4A, and an open position, seen in FIG. 4B. In the closed position, fluid flow is prevented through the restrictor 144; in the open position, fluid flows through the restrictor 144, through the chamber 143 and into the base pipe interior passageway 138. In the open position, the restrictor passageway is aligned with the screen port 141, allowing fluid flow through the port. In the closed position, the restrictor 144 is not aligned with screen port 141 and flow is prevented. Sealing element 143 prevents fluid flow along the exterior of the restrictor and between the restrictor and housing 132.

Swellable actuator 146 is positioned between the restrictor 144 and the exterior surface of the base pipe and is operable to actuate or move the restrictor from the closed to the open position. In one embodiment, the swellable actuator 146 is an annular section abutting the base pipe and the restrictor. The sides of the actuator preferably abut chamber side walls 147 (seen in FOG. 4C). When it is desired for the restrictor 144 to move to the open position, swelling is activated by either a chemical reaction (such as with a polymer) or by introducing heat (such as with a rubber). The swellable actuator 146 is in an initial, unswollen position, seen in FIG. 4A, and, after actuation, swells or expands to an activated or actuated, swollen position, seen in FIG. 4B. The swelling of the swellable actuator 146 force movement of the restrictor 144 from the closed to the open position.

Various techniques may be used for contacting or actuating the swellable material. An actuation fluid may already be present in the well when the flow control device is installed, or may be circulated through the well after the flow control device is in the well. As another alternative, the actuation fluid which causes swelling of the material may be produced from the formation surrounding the wellbore. The actuation fluid which causes swelling can be water and/or hydrocarbon fluid (such as oil, gas, diesel, etc.).

Various swellable materials are known to those skilled in the art, which materials swell when contacted with water and/or hydrocarbon fluid, so a comprehensive list of these materials will not be presented here. Partial lists of swellable materials may be found in U.S. Pat. Nos. 3,385,367 and 7,059,415, and in U.S. Published Application No. 2004-

0020662, the entire disclosures of which are incorporated herein by this reference for all purposes.

The ICD assembly 142 further preferably includes a guide assembly 149 for guiding the restrictor 144 between its closed and open positions. In one embodiment, the guide assembly 149 has a set of ribs or flanges 135 extending longitudinally and radially within the flow control housing and adjacent the restrictor 144. The restrictor 144 slides from its closed position to its open position between the flanges 135, or along the slot created by the flanges. The swellable actuator 146 forces the restrictor 144, or at least a portion thereof, radially outward from the base pipe and into the open position wherein the restrictor is aligned to allow flow between the screen and base pipe. In the embodiment shown, the restrictor pivots about one end as the other end is moved by the swellable actuator. Preferably the restrictor is bonded to the swellable actuator to prevent premature or accidental alignment. Alternately, a mechanical stop 151, shear mechanism, etc., can be employed to prevent radially outward movement of the restrictor until a preselected force is applied to the restrictor by the swellable actuator. Similarly, such locks or devices can be employed to maintain the restrictor in an open position even where the swellable material later constricts.

Alternate guide and actuation assemblies and configurations can be used and will be readily apparent to those of skill in art. For example, the restrictor can be moved radially inward, axially, rotationally, or circumferentially between a closed and open position. The swellable actuator can extend along the entire length of the restrictor or only a portion thereof. The restrictor is seen extending longitudinally, however, the inventive features disclosed herein can be incorporated for use with restrictors oriented circumferentially, radially, etc. Further, a swellable actuator can be used to move an end cover or stopper positioned sealingly with one end of the restrictor, wherein the restrictor remains stationary but the cover is forced away from the restrictor end upon actuation of the swellable actuator.

Figure 5A:
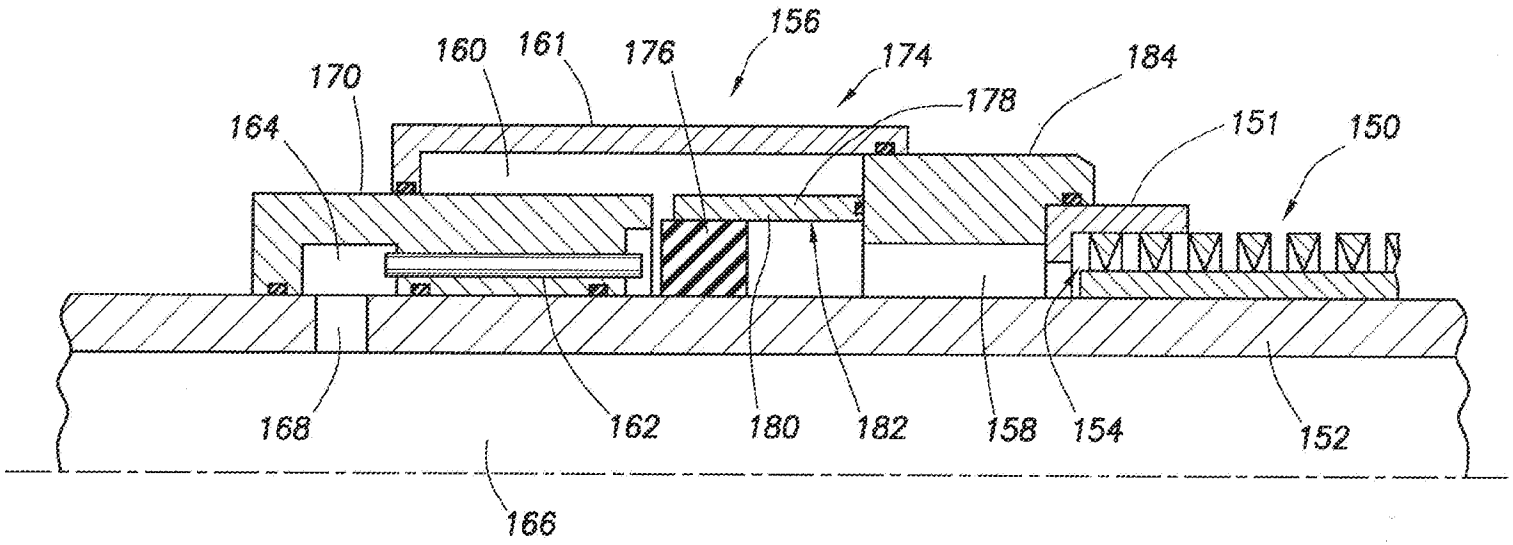
Figure 5B:
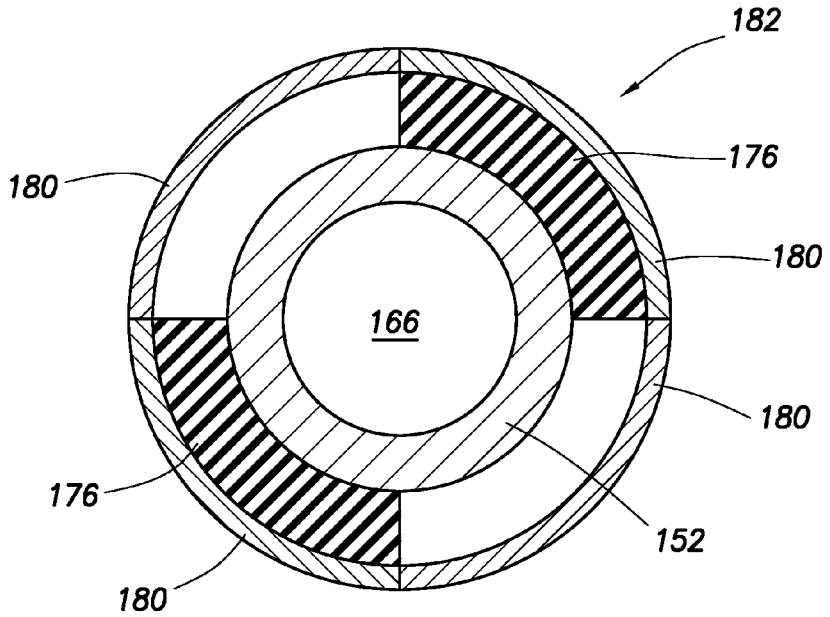
Figure 5D:
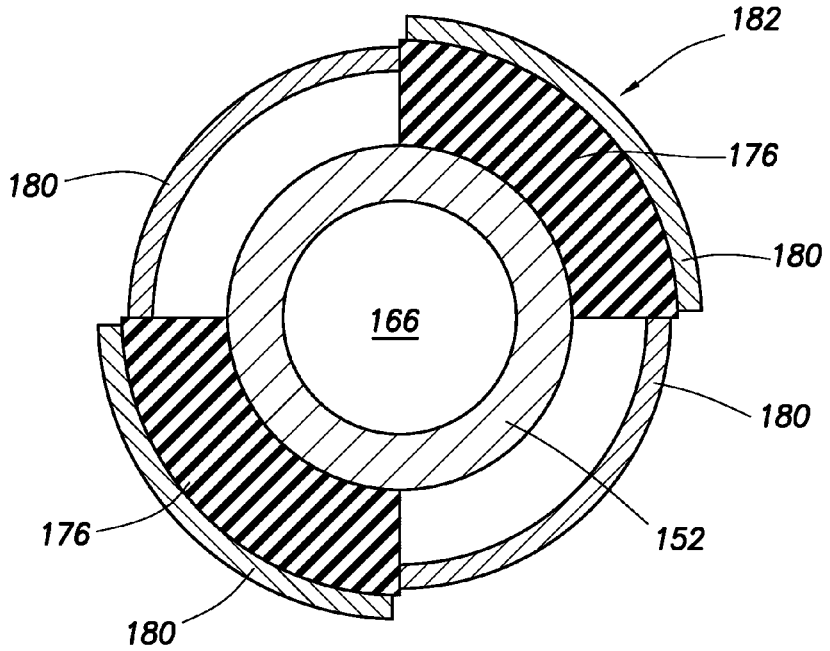
Figure 5C:
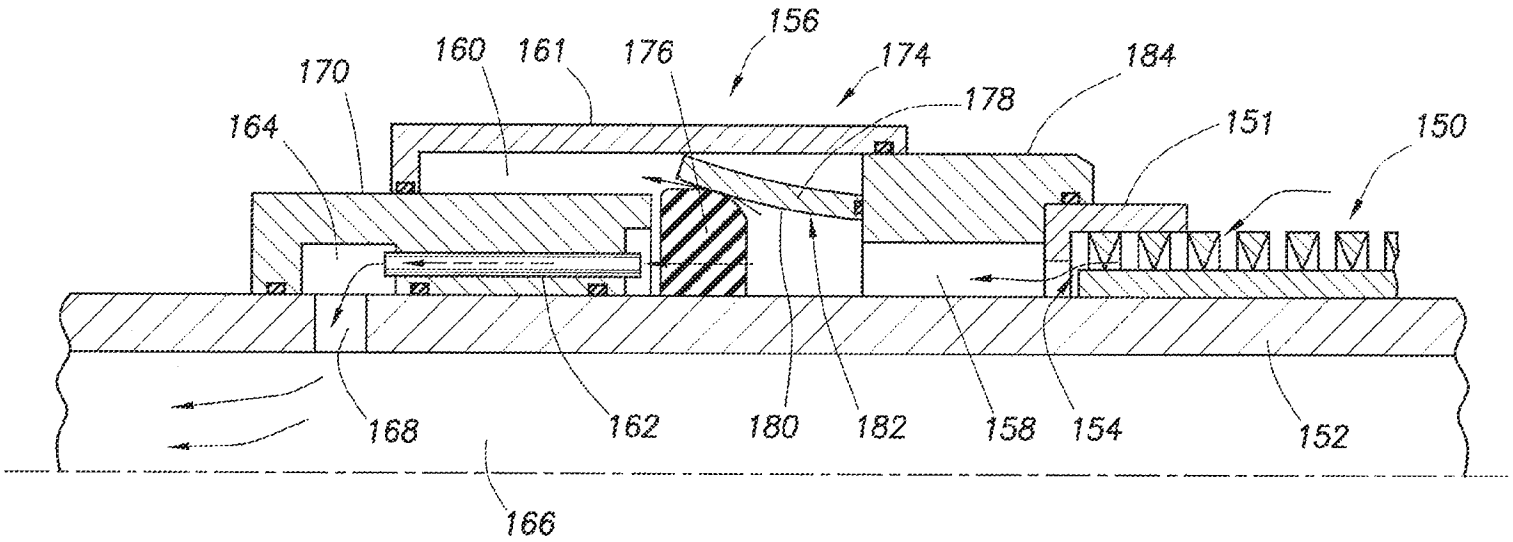

FIGS. 5A-D show another embodiment of an inflow control device in accordance with the present disclosure. FIG. 5A is a cross-sectional schematic of an exemplary ICD assembly and screen assembly mounted on a base pipe, with the ICD assembly in a closed position. FIG. 5B is a cross-sectional end view taken of FIG. 5A. FIG. 5C is the embodiment of FIG. 5A but with the ICD assembly in an open position. FIG. 5D is a cross-sectional view taken of FIG. 5C.

A screen assembly 150 is mounted on base pipe 152 and defines a screen port 154 allowing fluid flow between the screen assembly and ICD assembly. The ICD assembly 156 defines a first chamber 158 in fluid communication through port 154 with the screen assembly. The ICD assembly further defines a second chamber 160 in fluid communication with one end of restrictor 162. The ICD assembly further defines a third chamber 164 in fluid communication with the other end of the restrictor 162 and an interior passageway 166 defined by the base pipe 152, flow passing through a port 168 in the base pipe 152. The first chamber 158 and second chamber 160 are initially fluidly isolated with the ICD assembly in a closed position. The chambers are selectively openable to one another, allowing fluid flow between the chambers.

The ICD assembly 156 includes an ICD housing 170 which, in conjunction with the exterior surface of the base pipe, defines third chamber 164. Mounted or positioned to the ICD housing 164, and extending therethrough, is a flow restrictor 162 allowing controlled fluid flow between the chambers 160 and 164. The flow restrictor and alternative embodiments are discussed above and known in the art and will not be addresses again.

The ICD assembly further includes an actuator assembly 174 having a swellable actuator 176 and at least one movable member 178. The movable member is selectively movable between a closed position, seen in FIGS. 5A-B, and an open position, seen in FIGS. 5C-D. In a preferred embodiment, the movable member or members are fingers 180 of a collet 182. Those of skill in the art will recognize alternative shapes and configurations of movable members equivalent to the collet and collet fingers. The swellable actuator 176, collet 182, interference ring 184 and end of the screen assembly 150 define the first chamber 158. Alternative arrangements will be apparent to those of skill in the art.

Collet 182 is initially positioned in a closed, sealing position between the first and second chambers 158 and 160. Collet 182 has several fingers 180 that bend radially outward when sufficient force is applied thereto. Underneath at least one finger 180, and preferably under alternating fingers, is swellable actuator 176. At installation, the swellable actuator 176 is unswelled and the collet fingers 180 are flush to one another and in a closed position. Thus the flow restrictor 162 is closed. When it is desired to open the ICD assembly to fluid flow between the base pipe interior passageway 166 and screen assembly 150, a swelling activator, such as an actuating chemical or heat, is introduced to the swellable actuator 176. The swellable actuator then swells, moving or raising the collet fingers under which are positioned the swellable material. Movement of the collet fingers creates flow paths through the collet 182 between the fingers. Thus the ICD assembly is in an open position wherein fluid flows between the screen assembly and base pipe passageway 166 via the screen port 154, chambers 158, 160 and 164, the restrictor 162 and port 168. In the open position, a flow path is defined between the screen assembly and base pipe passageway via the indicated spaces and through the indicated elements.

The swellable actuator is addressed above and known in the art and not again discussed here. As those of skill in the art will recognize, the swelling of the swellable actuator can be controlled or guided with various structural features such as pockets, flanges, and the like. Similarly, introduction of actuating chemicals, details and alternatives for the restrictor, etc., are discussed elsewhere herein.

A person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. An assembly for regulating a flow rate between a wellbore extending through a subterranean formation and a tubular positioned in the wellbore, the assembly comprising:

the tubular;

a flow control housing disposed on the tubular and defining a flow control chamber;

a port extending between an interior passageway defined in the tubular and the flow control chamber;

a flow control path defined through the flow control housing and communicable with both the interior passageway of the tubular and the formation;

a flow regulation device disposed in the flow control path, the flow regulation device including at least one flow restrictor in the shape of an elongated tube dimensioned to control fluid flow therethrough; and a swellable actuator movable from a closed position wherein fluid is blocked from flowing through the elongated tube and along the fluid control path to an open position wherein fluid is allowed to flow through the elongated tube and along the fluid control path, and wherein the elongated tube is moved radially in response to swelling of the swellable actuator.

2. The assembly of claim 1 wherein the swellable actuator translates the flow restrictor into alignment with the flow control path when the swellable actuator swells.

3. The assembly of claim 1 wherein the swellable actuator swells in response to exposure to a chemical or to heat.

4. The assembly of claim 1 further comprising a screen assembly interposed between the flow control housing and the formation.

5. The assembly of claim 1 wherein the elongated tube is moved radially outward in response to swelling of the swellable actuator.

6. The assembly of claim 5 wherein the elongated tube is additionally pivoted in response to swelling of the swellable actuator.

7. The assembly of claim 1 wherein the flow restrictor defines a flow restrictor flow path, and wherein the swellable actuator moves the flow restrictor to a position wherein the flow restrictor flow path is aligned with a port of the flow control housing.

8. The assembly of claim 1 wherein the flow restrictor is positioned longitudinally.

9. The assembly of claim 1 further comprising a guide assembly for guiding the movement of the flow restrictor during swelling of the swellable actuator.

10. The assembly of claim 9 wherein the guide assembly further comprises flanges, ribs or slots for guiding the movement of the flow restrictor.

11. The assembly of claim 9 wherein the guide assembly further comprises at least one mechanical stop for maintaining the flow restrictor in a position.

12. The assembly of claim 1 wherein the swellable actuator swells in response to exposure to a water-based fluid or a hydrocarbon fluid.

13. The assembly of claim 1 wherein the swellable actuator moves a valve member from a closed position wherein fluid is blocked from flowing past the valve member to an open position wherein fluid is allowed to flow past the valve member.

14. The assembly of claim 13 wherein the valve member is at least one finger of a collet assembly.

15. The assembly of claim 14 wherein the swellable actuator is positioned between a collet finger and the tubular.

16. The assembly of claim 15 wherein the swellable actuator is a plurality of swellable members positioned beneath alternating collet fingers and operable to move the alternating collet fingers to a radially expanded position.

17. A method for regulating a flow rate between a wellbore extending through a subterranean formation and a tubular positioned in the wellbore, the method comprising the steps of:

positioning a downhole tubular defining an interior passageway and having a screen assembly and a flow control assembly having a flow regulation device disposed thereon in the well bore;

blocking fluid flow between the formation and the interior passageway of the tubular;

swelling a swellable actuator; and in response thereto, then allowing fluid flow between the formation and interior passageway of the tubular.

18. The method of claim 17 further comprising positioning a flow control housing between and in fluid communication with the interior passageway of the tubular and a port to the screen assembly, the flow control housing having the flow regulation device positioned therein.

19. The method of claim 18 wherein the flow regulation device is a flow restrictor forming a generally elongated tube dimensioned to control fluid flow therethrough.

20. The method of claim 18 wherein the step of swelling the swellable actuator further comprises the step of moving the flow regulation device from a closed to an open position, and wherein the step of allowing fluid flow further comprises flowing fluid through the flow regulation device.

21. The method of claim 20 wherein the step of swelling the actuator further comprises the step of moving the flow regulation device to an aligned position wherein fluid is allowed to flow therethrough.

22. The method of claim 20 further comprising the step of moving the flow regulator device radially outward, radially inward, longitudinally, pivotally, or circumferentially.

23. The method of claim 20 further comprising the step of guiding the movement of the flow regulation device from the closed to the open position.

24. The method of claim 23 wherein the step of guiding further comprises limiting movement of the flow regulation device in a selected direction.

25. The method of claim 17 further comprising the step of swelling the swellable actuator in response to introducing an activating chemical or heat to the swellable actuator.

26. The method of claim 17 wherein the step of swelling the swellable actuator further comprises the step of moving a valve member from a closed to an open position.

27. The method of claim 26 wherein the valve member comprises at least one collet finger.

* * * * *